United States Patent [19]

Scharfenberger

[11] 4,159,806

[45] Jul. 3, 1979

[54] OPERATION SEQUENCE CONTROL SYSTEM

[75] Inventor: James A. Scharfenberger, Indianapolis, Ind.

[73] Assignee: Ransburg Corporation, Indianapolis, Ind.

[21] Appl. No.: 832,439

[22] Filed: Sep. 12, 1977

[51] Int. Cl.[2] ..... B05B 5/02

[52] U.S. Cl. ..... 239/708

[58] Field of Search ..... 239/15, 70, 112, 113, 239/124, 127, 305, 3; 118/629, 627; 239/690–708

[56] References Cited

U.S. PATENT DOCUMENTS

| | | | |
|---|---|---|---|
| 3,691,991 | 9/1972 | Luderer | 239/15 AA |
| 3,870,233 | 3/1975 | Wilhelm et al. | 239/15 C |

*Primary Examiner*—James B. Marbert

*Attorney, Agent, or Firm*—Merrill N. Johnson; Richard D. Conard

[57] ABSTRACT

An apparatus for controlling a color change sequence of automatic paint spray equipment. The apparatus controls the performance of various cleaning functions when it is desired to convert the spray equipment from spraying one color of paint to spraying of another color of paint. The apparatus includes a fluid motor coupled through a reducing transmission to a drum-type programmer. The drum-type programmer includes a set of program sections, each section being divided into a plurality of sectors and each sector adapted to receive a cam plug. Each section is programmed by inserting cam plugs in selected sectors thereof. Fluid switches are mounted adjacent the drum programmer, at least one switch being associated with each of the sections of the drum programmer and responsive to the presence and absence of cam plugs from various ones of the sectors in its respective section of the drum programmer to control a color change function.

23 Claims, 5 Drawing Figures

OPERATION SEQUENCE CONTROL SYSTEM

This invention relates to apparatus for controlling an operation sequence, and particularly to a completely fluid-operated color change sequence control system for use with fluid spray coating equipment.

Automatic color change devices used to control the dispensing of various colors of fluid coating material from, for example, centrifugal spray atomizers or spray nozzles, are known. Such automatic color change devices have, in the past, included continuous chains with inserts for selected links of the chains that tripped microswitches.

Other devices to control automatic color change in the types of spray coating apparatus described included electronic solid-state timers. A problem generally with electrical apparatus is that such apparatus must be located remote from a paint spray booth or spray line. Remote location of electrical circuits is necessary to provide safety for an operator in the vicinity of the paint spray booth or line from ignition of solvents, etc. in the atmosphere surrounding the booth or line by the electrical apparatus.

A further disadvantage of devices such as solid-state timers has been that in order to obtain the degree of flexibility and adjustability necessary for conveyor line application of various colors of coating material to items of varying sizes and shapes, solid-state timers have been extremely complex. Typically, simple solid-state timers are too inflexible to be of any significant benefit in a complex color change sequence control.

The most widely used types of automatic color change sequence control timers are of the type known as end-point programmers. Typically, these programmers are of the drum-type and offer single cycle control by the paint line operator in one mode and by a remote automated signal in another mode. Various drum diameters are used, the larger diameters being used where more resolution (division of a period of time into smaller increments) is necessary. However, all known prior art systems are at least partly electrical, and the electrical equipment of these is required to be at a location remote from the spray zone to minimize the danger of explosions. Thus, whenever the operator of the spray line changes the color of the coating material being sprayed, or performs any other manual function required by the dispensing apparatus, he must move to an area remote from the coating line.

Accordingly, it is an object of the present invention to provide a fluid automatic system for controlling an operating sequence, such as a color change sequence for a fluid coating centrifugal atomizing system.

According to the invention, apparatus for timing an operating sequence includes a source of fluid under pressure, a fluid motor coupled to the source for actuation thereby, the fluid motor including an output shaft, a program wheel coupled to the output shaft and driven thereby, a plurality of fluid switches mounted in close proximity to the program wheel and including means for actuation by the program wheel to control various operations of the sequence.

According to the illustrative embodiments, a reducing-type gear box is coupled between the fluid motor output shaft and the program wheel. The program wheel is a drum programmer including a plurality of axially spaced-apart sections, at least one of the fluid switches being associated with each section. Each section is divided into a plurality of sectors, each sector representing a portion of the time required for the drum programmer to make a complete revolution. A plurality of cam plugs are provided, the plugs being adapted to be selectively inserted into the various sectors, and the states of the various fluid switches being controlled by the presence or absence of cam plugs from the various sectors of the drum programmer sections with which the various fluid switches are associated.

In the illustrative embodiment, the entire system is driven by compressed air.

The invention may best be understood by referring to the following description and accompanying drawings which illustrate the invention. In the drawings.

Figure 3A:
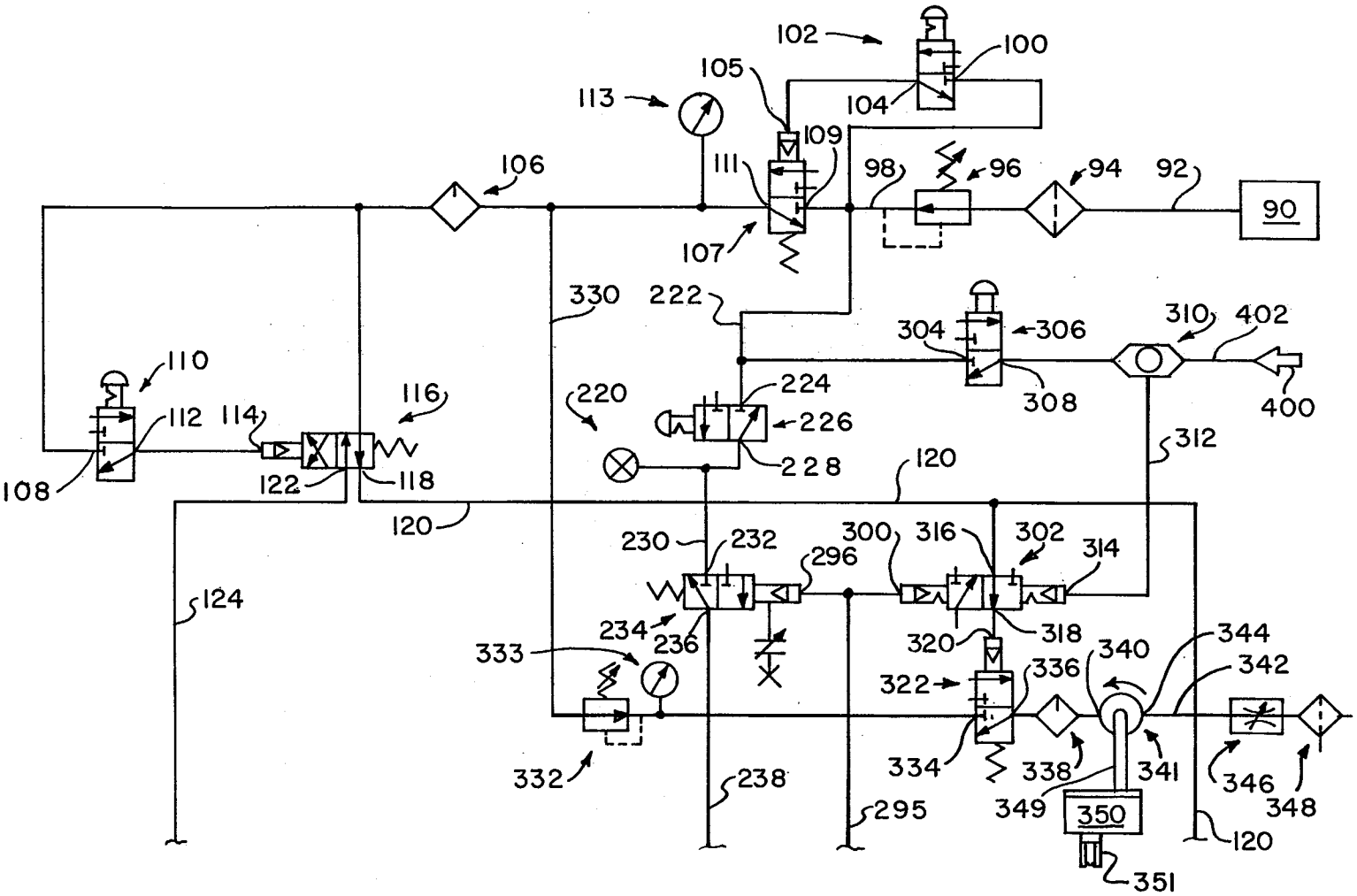
Figure 3B:
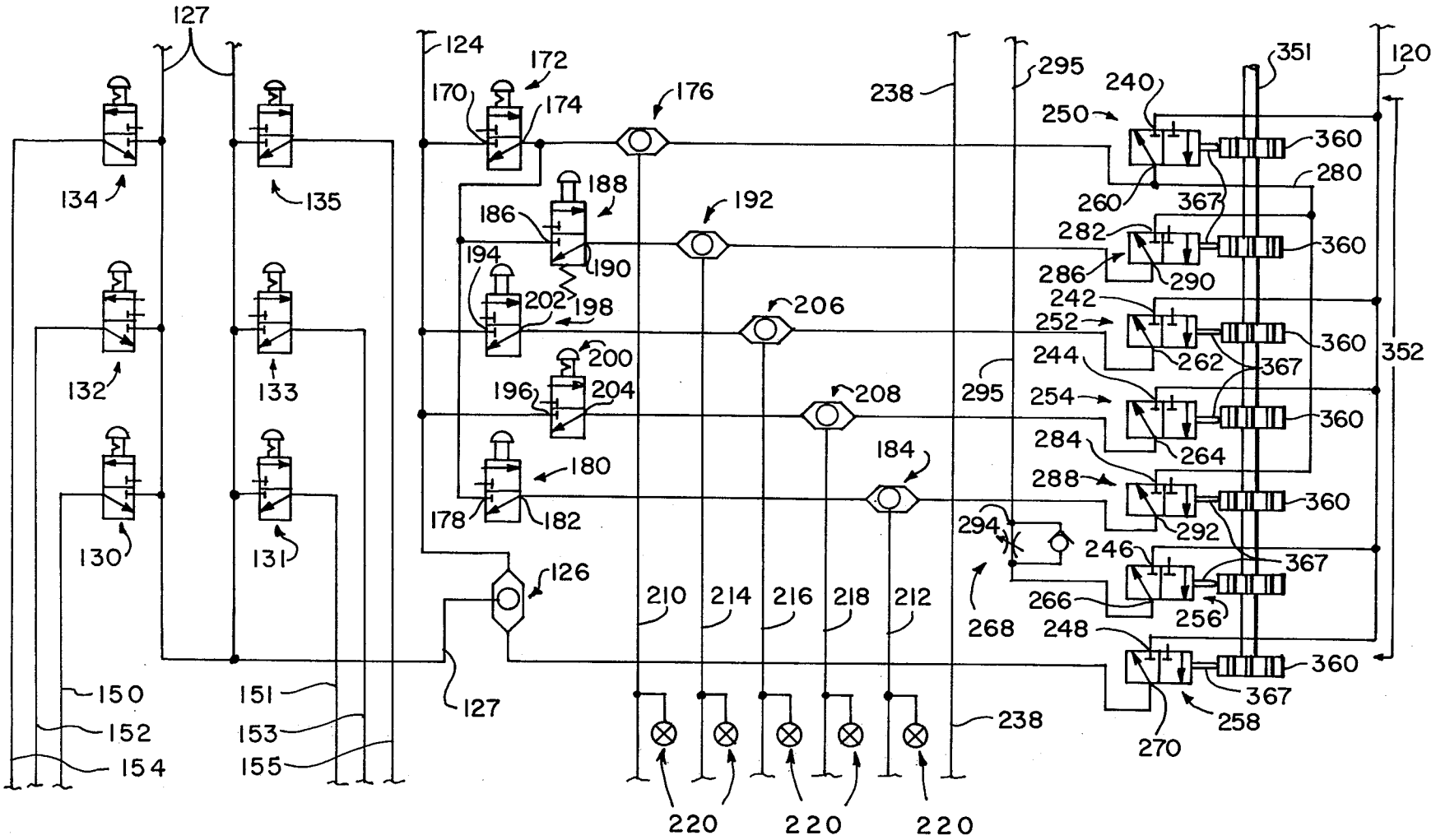
Figure 4:
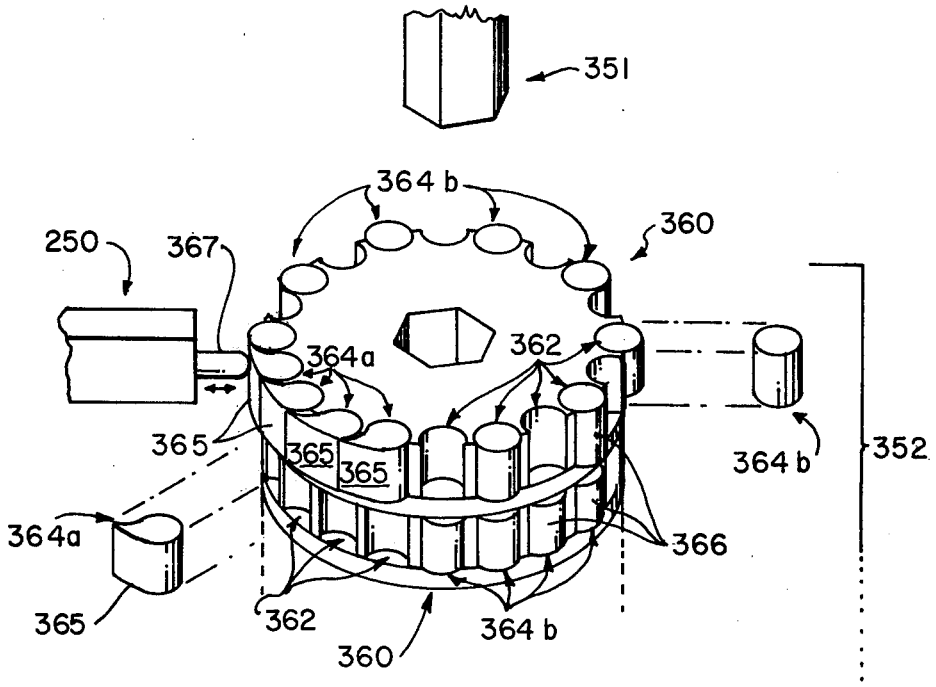

FIGS. 3*a–b* are schematic diagrams of a fluid circuit constructed according to the present invention; and, FIG. 4 is a fragmentary isometric view of a detail of an apparatus constructed according to the present invention.

Figure 1:
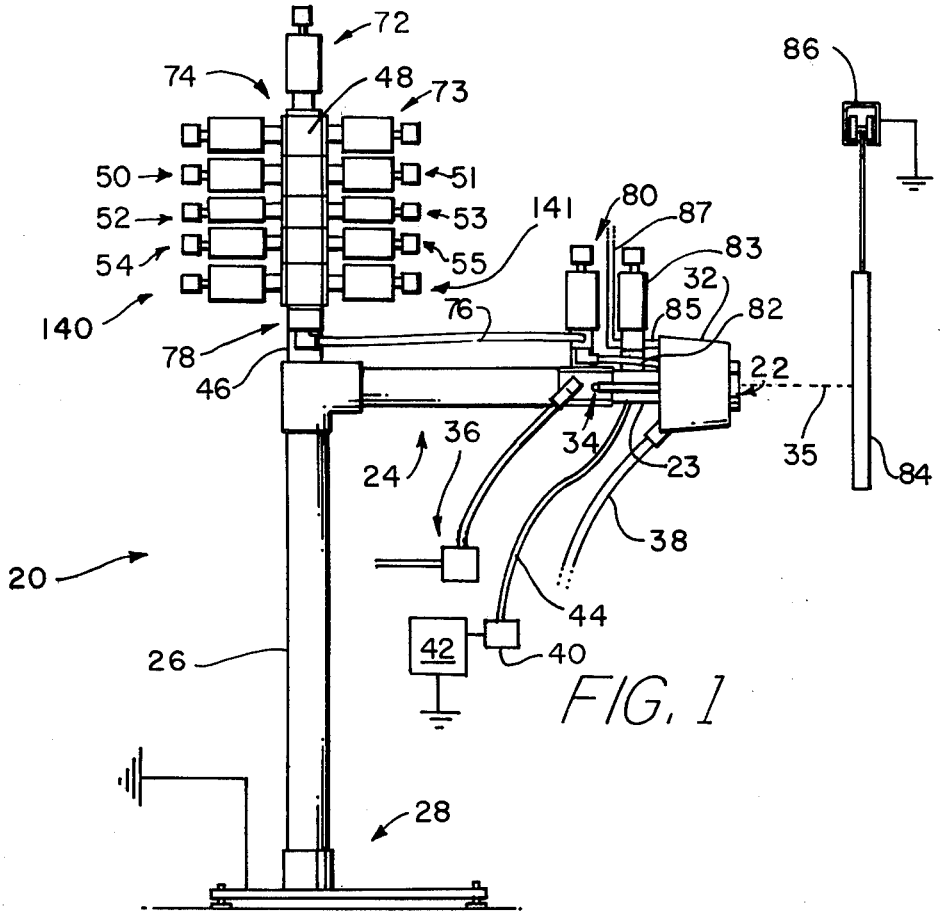
FIG. 1 is a somewhat diagrammatic side elevational view of a fluid coating material dispensing apparatus, the operation of which the instant apparatus is designed to control.

The dispensing apparatus 20 of FIG. 1 includes an atomizing device 22 mounted on an insulating leg 24 which projects generally horizontally from the vertical leg 26 of a supporting stand 28. The illustrated device 22 is of a type conventionally referred to as a "bell" or "mini-bell" atomizer. Atomizing device 22 is driven by an air motor 23 mounted at the outer end of insulating leg 24. Apparatus 20 further includes a generally cylindrical shroud 32 surrounding device 22. Shroud 32 is supported from a shroud-actuating air cylinder 34 which is actuable to project shroud 32 from the position illustrated in FIG. 1 along the rotational axis 35 of device 22 completely to surround device 22. Air cylinder 34 is activated by a shroud-projecting air valve 36 into its projected position. When air valve 36 is closed, the shroud 32 returns to its position illustrated in FIG. 1. A flexible drain tube 38 is attached to shroud 32 to drain fluids captured by the shroud 32. Air valve 36, when actuated, also opens a high voltage switch 40 on apparatus 20. When switch 40 is closed, high electrostatic potential is supplied from a high electrostatic potential source 42 (illustrated diagrammatically) through a line 44 to device 22.

The dispensing apparatus 20 further includes a vertical leg 46 which supports a color manifold 48. A plurality of air-operated color valves 50–55 control the flow of various selected colors of paint from individual supplies into color manifold 48. A solvent valve 72 is located at the head 74 of color manifold 48. A supply line 76 constructed from insulative material extends from the lowermost portion 78 of color manifold 48 to a triggering valve 80 mounted adjacent atomizing device 22. A feed tube 82 is attached to the output port of triggering valve 80. Feed tube 82 extends into the interior of atomizing device 22 to dispense paint flowing through a selected one of color valves 50–55 and manifold 48 into supply line 76 onto the interior of device 22. High-speed rotation of device 22 aids in atomization of this selected color of paint. For purposes of cleaning certain portions of the interior of device 22 during the color change cycle, a line 87 leads from a pressurized source of solvent (not shown) through a valve 83 and tube 85 to device 22 provided in apparatus 20. Tube 85 extends into the interior of device 22 and contains one or more small openings to dispense solvent into selected areas of device 22 to remove any remaining amounts of the last color therefrom before dispensing of the next color begins.

The atomized paint moves toward an item 84 moving along a grounded conveyor 86 due, in part, to the electrostatic charge on such atomized paint. Item 84 is thereby coated with this particular color of paint. A color change operation can be performed on the dispensing apparatus 20 so that a subsequent item moving along conveyor 86 can be coated with a different color of paint from another of color valves 50–55.

Figure 2:
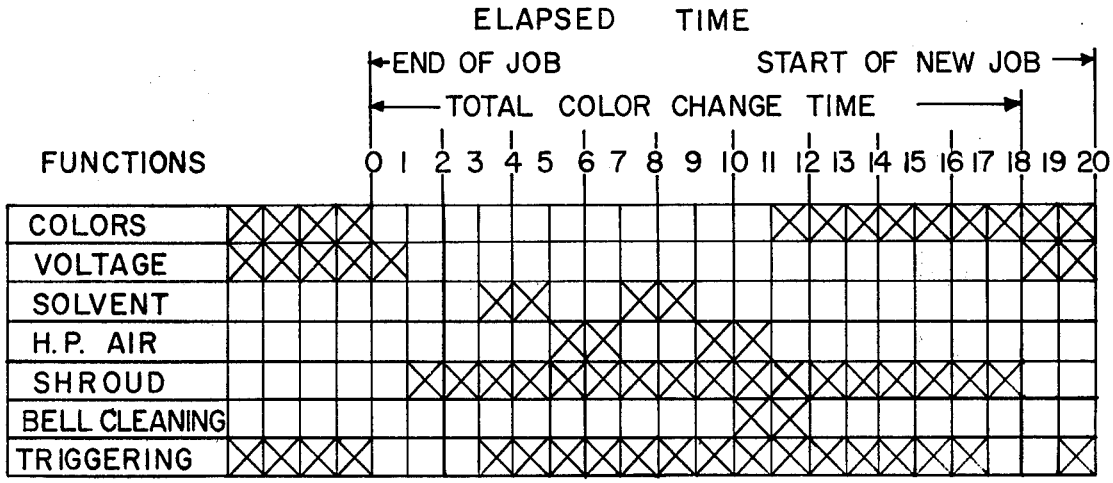
FIG. 2 is a typical timing chart, the various timing functions of which the instant apparatus is capable of performing.

The color change operation is performed in accordance with the function chart of FIG. 2. The function chart is divided into a number of different functions to be performed between the time labeled END OF JOB at which apparatus 20 ceases dispensing one color of paint, and the time labeled START OF NEW JOB at which apparatus 20 begins to dispense a different color of paint. As was discussed previously, these functions are conventionally controlled by chain controlled electrical switches, electronic timers and switches, or electrically driven drum programmers, which, due to the electric power requirements of such an apparatus, must be located some distance from the spray zone adjacent conveyor 86. This means that, for an operator to have "hands on" control on the selection of the color to be sprayed, the operator may be required to move back and forth between the spray zone and the electronic apparatus.

Assuming that apparatus 20 has been dispensing a color through one of valves 50–55 during an interval terminating at time "0" on the function chart, and that apparatus 20 is to begin dispensing a different color from another one of valves 50–55 beginning at time "20" on the function chart, the control system must perform the function as follows:

High electrostatic voltage, which is applied to the device 22 during the entire dispensing cycle for a given color, is disabled when the color dispensing function has been terminated. The voltage is maintained to device 22 until time "1" on the function chart has been reached. Prior to the beginning of the next job (point "20" on the function chart), the high electrostatic voltage is again enabled to apparatus 20, beginning at "18" on the function chart. Solvent is supplied from solvent valve 72 to apparatus 20 to flush the previously dispensed color from the apparatus between the end of a job at "0" on the function chart and the start of a new job at "20" on the function chart. As will be appreciated from FIG. 2, solvent is supplied to apparatus 20 in two two-unit time intervals between time "3" and time "5", and between time "7" and time "9". High pressure air is supplied to dry solvent remaining after the solvent flushes. The air is supplied in two two-unit intervals immediately after solvent has been supplied to the apparatus 20, the high pressure air being applied between times "5" and "7" and between times "9" and "11".

As was previously discussed, device 22 is surrounded by shroud 32 which is movable along axis 35 of device 22 effectively to enclose device 22 at the end of a dispensing cycle of one color. In its projected position, shroud 32 intercepts coating material and solvents which pass through the atomizing device 22 during the color change interval. These materials are conducted away from shroud 32 through drain 38. This function is illustrated as "shroud" in the function chart. As will be appreciated, the shroud is in its projected position between times "1" and "18".

Commencement of the device 22 cleaning function "bell clean" between times "10" and "12" actuates the solvent valve 83, causing solvent to flow through line 85. Line 85 is routed into the interior of device 22 to three jets (not shown) within device 22, from which jets the solvent is dispensed in fine streams into recessed areas of the atomizing device 22 to clean any remaining color from these areas.

The "triggering" function line of the function chart illustrates that the triggering valve 80, which generally controls flow through the feed tube 82, is open almost continuously. Triggering valve 80 only closes between the end of a job, at "0" on the function chart, and time "3" after the end of a job and between time "17", after the end of a job and time "19" (one time unit before the start of a new job).

Turning now to FIGS. 3*a–b*, the apparatus for controlling the various paint color dispensing valves 50–55, the solvent valve 72, the triggering valve 80, the air purge valve 73, the voltage-off shroud projecting air valve 36 and associated components will be explained in greater detail. The fluid circuit diagram of FIGS. 3*a–b* has been divided for purposes of convenience.

With the apparatus of FIGS. 3*a–b*, the various color change functions can be performed automatically without the need for any electronic circuitry. In the apparatus of FIGS. 3*a–b*, compressed air is provided from a supply 90 (illustrated diagrammatically in FIG. 3*a*) through a line 92, a series filter 94, and variable regulator 96, to a line 98. Line 98 couples supply 90 to an input port 100 of a manually detented "on/off" valve 102.

The output port 104 of valve 102 is coupled to a piloting input port 105 of an automatic reopening piloted "power" valve 107. The input port 109 of valve 107 is connected to line 98. The output port 111 of valve 107 is coupled through a filter 106 to the input port 108 of a manually detented "manual/automatic mode selector" valve 110. A pressure gauge 113 is provided at the output port 111 of valve 107. The output port 112 of valve 110 is coupled to the piloting input port 114 of a single pilot four-way valve 116. Manual closing of mode selector valve 110 (to the position illustrated in FIG. 3*a*) causes compressed air to be supplied from filter 106 through valve 116 to output port 118 thereof, to line 120 which is connected to output port 118. An output port 122 of valve 116 and a line 124 which is connected thereto are exhausted to atmosphere when valves 110, 116 are in these positions. These are the valve 110, 116 positions in the automatic mode of the systems. When valve 110 is depressed, the system is in its manual mode and output port 122 and line 124 are connected to the air supply through filter 106, and output port 118 and line 120 are exhausted to atmosphere.

Line 124 is connected through a shuttle valve 126 (FIG. 3*b*) and output line 127 to a plurality of separate manually detented "color select" valves 130–135. The output ports of valves 130–135 are coupled through lines 150–155 respectively, to control respective ones of valves 50–55 (FIG. 1). Valves 130–135 thereby control the dispensing of the various colors by centrifugal atomizing device 22. Of course, additional colors and additional valves, can be added to manifold 48 as shown at 140, 141 in FIG. 1, and by adding more manually detented color valves and control lines to line 127 in FIG. 3*b*. The operator, by manually switching one of valves 130–135, causes one of the respective colors controlled by valves 50–55 to be dispensed.

Line 124 is coupled to the input port 170 (FIG. 3*b*) of a manually detented "voltage off/shroud out" valve 172. The output port 174 of valve 172 is coupled to a shuttle valve 176 and to the input port 178 of a manual, automatic-reopening "device solvent flush" valve 180. The output port 182 of valve 180 is coupled to an input port of a shuttle valve 184.

The output port 174 of valve 172 is coupled to the input port 186 of a manual, automatic-reopening "solvent purge" valve 188. The output port 190 of valve 188 is connected to an input port of a shuttle valve 192.

Line 124 is coupled to the input ports 194, 196 of a manual, automatic-reopening "air purge" valve 198 and a manually detented "triggering" valve 200, respectively. The output ports 202, 204, respectively, of valves 198, 200 are coupled to input ports of shuttle valves 206, 208, respectively.

The output port of shuttle valve 176 is connected by a line 210 to air valve 36 of FIG. 1 to control the supply of high electrostatic potential to device 22, and to control the projection of shroud 36 over device 22 during flushing operations prior to a color change. The output port of shuttle valve 184 is connected by a line 212 to valve 83 (FIG. 1) which controls the flow of solvent through line 85 to the spaces within atomizing device 22 where small amounts of the last paint color to be dispensed might otherwise remain at the beginning of the next painting cycle. A line 214 is coupled between the output port of shuttle valve 192 and an input port of the "solvent purge" valve 72 (FIG. 1) to control the bulk flow of solvent through color manifold 48 to remove amounts of the last paint color dispensed therefrom prior to the beginning of the next painting cycle. A line 216 is connected from the output port of shuttle valve 206 to an input port of "air purge" valve 70 (FIG. 1) to control the air purge cycle after solvent purging of manifold 48. A line 218 is coupled between the output port of shuttle valve 208 and the input port of the "triggering" valve 80 (FIG. 1) to control the flow of material through feed tube 82 to atomizing device 22. A pneumatically actuated indicator or "flag" 220 is coupled to each of lines 210–218 to indicate when these lines are pressurized.

The output port of regulator 96 (FIG. 3*a*) is coupled through a line 222 to an input port 224 of a manually detented "automatic/manual voltage reset" valve 226. The output port 228 of valve 226 is coupled through a line 230 to the input port 232 of a piloted pulse valve 234. A flag 220 is placed in line 230 to provide a visual indication when this line is pressurized. The output port 236 of pulse valve 234 carries an air pulse of predetermined adjustable duration through a line 238 (FIGS. 3*a* and *b*) to the high electrostatic potential switch 40 (FIG. 1) when valve 226 is manually opened and valve 234 is piloted open. This fluid pulse sets switch 40, providing high electrostatic potential to device 22.

When mode selector switch 110 (FIG. 3*a*) is not in the depressed position, and line 120 is pressurized, air is supplied through line 120 to the input ports (FIG. 3*b*) 240, 242, 244, 246, 248 of normally closed cam-operated three-way valves 250, 252, 254, 256, 258, respectively. Valve 250 is the automatic "voltage off/shroud out" valve, and its output port 260 is coupled to an input port of shuttle valve 176. Valve 252 is the automatic "air purge" valve. Its output port 262 is coupled to an input port of shuttle valve 206. Valve 254 is the automatic "triggering" valve. Its output port 264 is coupled to an input port of shuttle valve 208. Valve 256 is the automatic "cycle complete" valve. Its output port 266 is coupled to an input port of a combination variable line restrictor/check valve 268 which permits flow from the line restrictor/check valve 268 into output port 266 and permits restricted flow from output port 266 through line restrictor/check valve 268. Valve 258 is the automatic "color" valve, and its output port 270 is coupled to an input port of shuttle valve 126.

A line 280 is coupled between output port 260 and the input ports 282, 284 of normally closed cam-operated three-way valves 286, 288, respectively. Valve 286 is the automatic "solvent purge" valve and its output port 290 is coupled to an input port of shuttle valve 192. Valve 288 is the automatic "device solvent flush" valve and its output port 292 is coupled to an input port of shuttle valve 184.

The output port 294 of line restrictor/check valve 268 is coupled through a line 295 to a piloting input port 296 (FIG. 3*a*) of pulse valve 234. Thus, pressure in line 295 causes the fluid pulse of predetermined duration to appear at output port 236 of pulse valve 234 when input port 232 of pulse valve 234 is pressurized. Line 295 is also coupled to a "stop run" detented piloting input port 300 of a double-piloted four-way "motor control" valve 302.

Line 222 is coupled to an input port 304 of a momentary closing "manual run" valve 306. The output port 308 of valve 306 is coupled to an input port of a shuttle valve 310. The output port of shuttle valve 310 is coupled through a line 312 to a detented piloting input "run" port 314 of "motor control" valve 302. An input port 316 of valve 302 is coupled to line 120. The output port 318 of valve 302 is coupled to a piloting input port 320 of a single-piloted three-way automatic reopening "motor run" valve 322.

"Power" valve 107 is coupled through a line 330 to an input port of a motor "coarse speed adjust" regulator 332. A pressure gauge 333 is provided at the output port of regulator 332. The output port of regulator 332 is coupled to an input port 334 of run valve 322. The output port 336 of run valve 322 is coupled through a lubricator/filter 338 to an input port 340 of an air motor 341. A line 342 is coupled between the output port 344 of air motor 341 and a "fine speed adjust" variable restrictor 346 which is useful to provide fine adjustment of the air motor 341 output r.p.m. after coarse adjustment of such r.p.m. has been obtained using speed adjust regulator 332. The output port of variable restrictor 346 is coupled to the input port of a filter 348, the output port of which is exhausted to atmosphere.

The output shaft 349 of air motor 341 drives a speed-reducing transmission 350, the output shaft 351 of which drives a drum programmer 352 (FIG. 3*b*). As best illustrated in FIG. 4, drum programmer 352 is of a type which is divided into a plurality of axially spaced apart sections 360 (only two of which are illustrated in FIG. 4). Each section 360 is divided into a plurality of equal peripheral length sectors 362. A number of cam plugs 364 are provided, the cam plugs 364 being selectively manually insertable into various ones of sectors 362 to provide the desired cam surface 366 for each axially spaced-apart section 360 of programmer 352. Cam plugs 364 are of two types: type 364*a* provide surfaces 365 for continuous operation of respective ones of valves 250, 252, 254, 256, 258, 286, 288 throughout one of sectors 362; Type 364*b* provides surfaces for on-and-off operation of respective ones of valves 250, 252, 254, 256, 258, 286, 288 during one of sectors 362. Cam plugs 364*a* are generally "comma shaped" in cross section. Cam plugs 364*b* are right circular cylindrical in cross section.

Each of valves 250, 252, 254, 256, 258, 286, 288 is located adjacent a respective one of the sections 360 of drum programmer 352 and includes a follower 367 contacting a respective cam surface 366. Proper selective positioning of the cam plugs 364*a*, *b* in the various sectors 362 provides a color change sequence in accordance with the function chart illustrated in FIG. 2.

The air motor 341, transmission 350, and drum programmer 352 are all of types available from various sources, such as Gemco Electric Division of McGraw-Edison, 1080 N. Crooks Road, Clawson, Mich. 48017. The manual and automatic air valves are all of types available from various sources, such as Humphrey Products, Kalamazoo, Mich. 49003.

In operation, the present system is energized by depressing manually detented "on-off" valve 102, which pilots "power" valve 107 into the open position. If "mode selector" switch 110 is in the manual mode, line 124 is pressurized. Shuttle valve 126 provides compressed air to the input ports of the various "color select" valves 130–135 (FIG. 3*b*). The operator selects the color to be dispensed by apparatus 20 by actuating one of valves 130–135. The operator manually switches "on" the high electrostatic potential to device 22. When the operator desires to change colors, he closes the "triggering" valve 200 which closes valve 80 (FIG. 1), which has been open during the entire color dispensing cycle. Then he releases the previously selected color valve 130–135 and opens the "voltage off/shroud out" valve 172, switching the high electrostatic potential from device 22 and projecting shroud 32 axially outwardly to surround device 22. Next he depresses "triggering" valve 200 to open valve 80 of FIG. 1, to allow solvent flow through color manifold 48, supply line 76, feed tube 82, tube 85 and device 22 as desired by hand-actuation of valves 180, 188 (FIG. 3*a*). Any solvent remaining in these various components is dried by hand-actuation of "air purge" valve 198.

If it is desired to run the system in the automatic mode, the operator leaves mode selector valve switch 110 in its illustrated position (FIG. 3*a*), connecting the air supply to line 120. Depending upon whether the operator wants the high electrostatic potential to be returned to device 22 at the end of the color change cycle, the "automatic/manual voltage reset" valve 226 is depressed (to return high electrostatic potential to device 22) or left in its closed condition, illustrated in FIG. 3*a*, (to keep high electrostatic potential from device 22 until the operator manually returns such potential to the device). The operator then starts air motor 341 by depressing the momentary closing "manual run" valve 306 to send a pressure signal through shuttle valve 310 and line 312 to the piloting input "run" port 314 of valve 302. This signal latches valve 302 in its "run" position providing pressure at the piloting input port 320 of "motor run" valve 322. This condition connects air motor 341 through filter 338 and regulator 332 to the supply. Air motor 341 begins to turn, driving the drum programmer 352 through transmission 350 at an r.p.m. determined by the settings of "speed adjust" regulator 332 (for coarse adjustment) and variable restrictor 346 (for fine adjustment). As the drum programmer 352 is rotated, "triggering" valve 254 is opened, causing triggering valve 82 on apparatus 20 to be open. The device 22 dispenses atomized and charged paint particles onto one or more items 84 on conveyor 86. The color is determined by the positions of color valves 50–55 (FIG. 1), which in turn depend upon the positions of the "color select" valves 130–135 (FIG. 3*b*). Prior to initiating the first operating cycle, the operator has selected a color for items 84.

As the end of a group of items 84 to be painted a particular color is reached, the drum programmer 352 reaches a point at which it keys the various valves 250, 252, 254, 256, 258, 286, 288 (FIG. 3*b*) to perform their various function in accordance with the function chart (FIG. 2). The function instructions are coupled through shuttle valves 176, 184, 192, 206 and 208 and through lines 210, 212, 214, 216, and 218 in the same manner as color change instructions are provided in the "manual run" mode. In the "automatic" mode, paint dispensing is stopped by closing automatic color valve 258, thereby removing the pressure from the output port of shuttle valve 126, rather than be manually closing the open "color select" valve 130–135. The presence of high pressure at the output port 266 of "cycle complete" valve 256 is relayed through the line restrictor/check valve 268 and line 295 to the piloting input port 296 (FIG. 3*a*) of pulse valve 234. If the "automatic/manual voltage reset" valve 226 is in the normally closed position, as illustrated, no high electrostatic potential resetting pulse will be delivered through line 238, and the high electrostatic potential will remain "off" to device 22 at the end of the color change cycle. If valve 226 is in its detented, or open position, fluid pressure will be present at the input port 232 of pulse valve 234 when pressure is supplied to the piloting input port 296 thereof, and a pulse will be provided from the output port 236 of pulse valve 234 to switch the high electrostatic potential on to device 22 so that the device will be ready to begin its next operating cycle.

The pressure present on line 295 at the end of an operating cycle is also supplied to the "stop run" piloting input port 300 of valve 302. This signal detents valve 302 into the "stop run" position, removing pressure from the output port 318 thereof, and from the piloting input port 320 of motor run valve 322. Air motor 341 stops. However, provision is made for an additional input 400 through a line 402 to an input port of shuttle valve 310. This additional input may be in the form of a "start sequence" signal from an additional manually operated fluid valve (not shown) or from some time-delay device so that a high pressure signal exists on kline 402 after the end of the "stop run" piloting signal on line 295. Such an additional input will detent the piloting input 314 of valve 302 to the "run" position providing a path for air pressure from the input port 316 to the output port 318 of valve 302, and thus piloting input port 320 of "motor run" valve 322 to initiate the next operating cycle of the dispensing apparatus 20. This additional input 400 to begin the next operating cycle could also be keyed to the selection by the operator of a new color as he manually switches another one of valves 130–135 to the open position.

It is understood that the items on the conveyor 86 can be at some potential other than ground and device 20 grounded in accordance with the invention.

it should further be understood that device 22 may be mounted in a vertical orientation, rather than in the illustrated horizontal orientation. In such situation, drain tube 38 may be connected to a suitable evacuation pump, the operation of which may be controlled in a similar manner to the various functions illustrated in the function chart (FIG. 2) by additional fluid circuit apparatus.

I claim:

1. Apparatus for timing an operation sequence comprising a source of fluid under pressure, a fluid motor coupled to the source for actuation thereby, the fluid motor including an output shaft, a program wheel coupled to the output shaft for rotation, and a plurality of switches mounted adjacent the program wheel and including means responsive to rotation of the program wheel for actuation thereby.

2. The apparatus of claim 1 wherein the switches are fluid valves.

3. The apparatus of claim 2 wherein the fluid valves form a control circuit coupled to the same fluid source as the motor.

4. The apparatus of claim 3 wherein the fluid source is a source of compressed air.

5. The apparatus of claim 1 wherein a transmission is coupled to the output shaft and to the program wheel, the fluid motor driving the wheel through the transmission.

6. The apparatus of claim 5 wherein the transmission reduces the motor shaft rotation rate to the program wheel rotation rate.

7. Apparatus for timing an operation sequence comprising a source of fluid under pressure, a fluid motor coupled to the source for actuation thereby, the fluid motor including an output shaft, a program wheel coupled to the output shaft for rotation, and a plurality of switches mounted adjacent the program wheel and including means responsive to rotation of the program wheel for actuation thereby, the program wheel comprising a drum-type programmer having a plurality of axially spaced-apart cam surfaces, at least one of the switches being located adjacent a respective cam surface and including means contacting its respective cam surface for control thereby.

8. The apparatus of claim 7 wherein the axially spaced-apart cam surfaces are provided by a plurality of axially spaced-apart program wheel sections, each section being divided into a plurality of peripherally spaced-apart sectors, and a plurality of selectively insertable cam plugs sized to be received in selected ones of the sectors of each section to provide the cam surfaces.

9. Apparatus for controlling a color change sequence of automatic coating dispensing equipment, the apparatus comprising a source of fluid under pressure, a fluid motor coupled to the source for actuation thereby, the fluid motor including an output shaft, a program wheel coupled to the output shaft for rotation, and a plurality of switches mounted adjacent the program wheel and including means responsive to rotation of the program wheel for actuation thereby.

10. The apparatus of claim 9 wherein the switches are fluid valves.

11. The apparatus of claim 10 wherein the fluid valves form a control circuit coupled to the same fluid source as the motor.

12. The apparatus of claim 11 wherein the fluid source is a source of compressed air.

13. The apparatus of claim 9 wherein a transmission is coupled to the output shaft and to the program wheel, the fluid motor driving the wheel through the transmission.

14. The apparatus of claim 13 wherein the transmission reduces the motor shaft rotation rate to a suitable program wheel rotation rate.

15. Apparatus for controlling a color change sequence of automatic coating dispensing equipment, the apparatus comprising a source of fluid under pressure, a fluid motor coupled to the source for actuation thereby, the fluid motor including an output shaft, a program wheel coupled to the output shaft for rotation, and a plurality of switches mounted adjacent the program wheel and including means responsive to rotation of the program wheel for actuation thereby, the program wheel having a plurality of axially spaced-apart cam surfaces, at least one of the switches being located adjacent a respective cam surface and the means responsive to rotation of the programming wheel including means for contacting its respective cam surface to be controlled thereby.

16. The apparatus of claim 15 wherein the axially spaced-apart cam surfaces are provided by a plurality of axially spaced-apart program wheel sections, each section being divided into a plurality of peripherally spaced-apart sectors, and a plurality of selectively insertable cam plugs sized to be received in selected ones of the sectors of each section to provide the cam surfaces.

17. Apparatus for controlling a color change sequence of automatic coating dispensing equipment, the apparatus including a fluid motor having an output shaft, a source of driving fluid for the motor, a drum-type programmer for providing a plurality of sequence-controlling cam surfaces, a transmission for coupling the motor to the programmer, a plurality of fluid valves, at least one fluid valve being located adjacent each of the cam surfaces and including means responsive to its respective cam surface to be controlled thereby, the equipment including a plurality of members for performing the various functions of the sequence, each of the fluid valves being coupled to at least one of the members for controlling it.

18. The apparatus of claim 17 wherein the fluid is compressed air.

19. The apparatus of claim 17 wherein the transmission reduces the motor speed to the programmer speed.

20. The apparatus of claim 17 wherein the members are air actuated.

21. The apparatus of claim 17 wherein the equipment includes a centrifugal atomizing device and means for spinning it to atomize the coating material being dispensed.

22. The apparatus of claim 21 wherein the equipment includes a source of high electrostatic potential and means for selectively coupling the potential source to the centrifugal atomizing device to supply a high electrostatic charge to the atomized particles of coating material being dispensed, the selective coupling means including one of the function-performing members.

23. Apparatus for controlling a color change sequence of automatic coating dispensing equipment, the apparatus including an air motor, a source of compressed air for the motor, an end-point programmer for providing a plurality of sequence-controlling cam surfaces, a reducing-type transmission for coupling the motor to the programmer, the transmission reducing the motor speed to a slower speed for the programmer, a plurality of air valves, at least one air valve being located adjacent each of the cam surfaces and including means responsive to its respective cam surfaces to be controlled thereby, the equipment including a plurality of air-actuated members for performing the various functions of the sequence, each of the air valves being coupled to at least one of the function-performing members for controlling it.

* * * * *